United States Patent [19]

Lang

[11] 4,438,999

[45] Mar. 27, 1984

[54] WIRE PIN CONNECTOR FOR RIBBON CABLE

[75] Inventor: Donald D. Lang, Garden Grove, Calif.

[73] Assignee: Allied Corporation, Morris Township, Morris County, N.J.

[21] Appl. No.: 63,282

[22] Filed: Aug. 2, 1979

[51] Int. Cl.[3] ..... H01R 13/00

[52] U.S. Cl. ..... 339/176 MF

[58] Field of Search ..... 339/17 F, 176 MF, 20–24, 339/157, 210

[56] References Cited

U.S. PATENT DOCUMENTS

| | | | |
|---|---|---|---|
| 1,877,103 | 9/1932 | Whiting | 339/21 R |
| 2,958,926 | 11/1960 | Morison | 339/17 C |
| 2,978,800 | 4/1961 | Blain | 339/17 C |
| 3,102,767 | 9/1963 | Schneck | 339/176 MF |
| 3,365,694 | 1/1968 | Parker | 339/17 F |
| 3,434,093 | 3/1969 | Wedekind | 339/176 MF |
| 4,066,840 | 1/1978 | Allgaier | 339/176 MF |
| 4,160,573 | 7/1979 | Weisenburger | 339/176 MF |

*Primary Examiner*—Joseph H. McGlynn
*Attorney, Agent, or Firm*—James P. DeClercq

[57] ABSTRACT

A termination block for ribbon cable (1) is disclosed, wherein the ends of the conductor wires in the ribbon cable form pin (12) of a connector for attaching the ribbon cable to a printed circuit board or the like. Insulation is removed from the end of the ribbon cable, and the individual conductors are placed in grooves (*7a, 7b*) in a base member, and retained by a cover member. A forming blade (30) is passed through apertures, aligned with the grooves, in both base and cover members to force a portion of conductor wire through the base member. In a preferred embodiment, the conductor wire is formed into a U-shape protruding from the base, which is then compressed to form a pin (12) to mate with holes in a printed circuit board or the like.

11 Claims, 9 Drawing Figures

WIRE PIN CONNECTOR FOR RIBBON CABLE

BACKGROUND OF THE INVENTION

This invention relates to electrical connections for planar cable, such as ribbon cable.

The term "ribbon cable" as used herein, is intended to denote a flat cable comprising a plurality of parallel solid or stranded conductors laminated between layers of an insulating material, such as polyvinyl chloride, teflon, or the like. It is often necessary to connect such cable to a printed circuit board or the like. Several ways of making such a connection have been used. The individual ribbon cable connectors may be soldered to individual conductors on a printed circuit board, a tedious task, and requiring separate mechanical support of the ribbon cable to avoid damaging the printed circuit board or the connections, should the cable be moved. Ribbon cable conductors have been soldered or wire wrapped to pins protruding from a dual-inline plug, which mates with a dual-inline-socket of the type used for integrated circuits, which in turn is attached to printed circuit board conductors. It is also known to solder or wire wrap ribbon cable conductors to the terminals of a connector, which fits over the edge of a printed circuit board or mates with another connector mounted on a printed circuit board. The present invention overcomes numerous difficulties and deficiencies of the above-mentioned connection techniques.

SUMMARY OF THE INVENTION

It is a primary object of the invention to provide improved electrical connection means for connecting ribbon cable conductors to a printed circuit board or the like.

A further object is to provide an improved electrical connection wherein the conductor wires from connector pins.

A further object of the invention is to provide a method for connecting ribbon cable conductors to printed circuit boards.

A further object is to provide a termination block for ribbon cables which is simple, inexpensive, and easy to make and use.

DESCRIPTION OF THE PREFERRED EMBODIMENT

Figure 1:
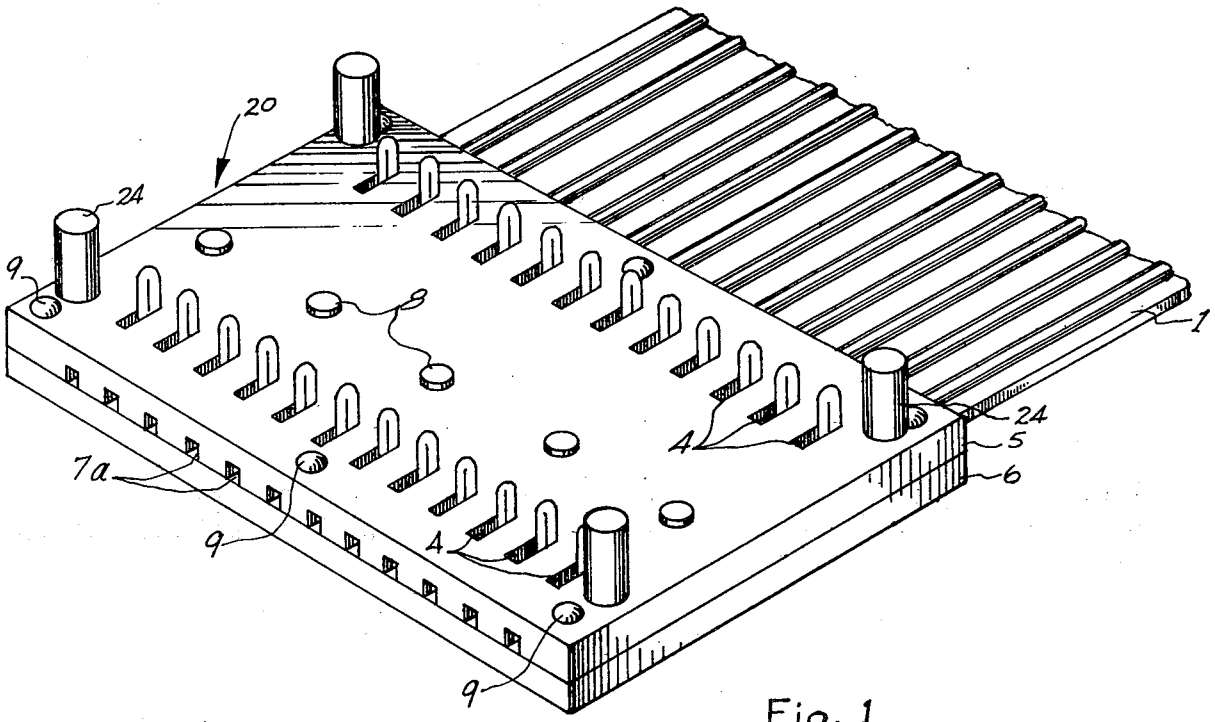
FIG. 1 is an inverted perspective view of a completed wire pin connector termination block for ribbon cable according to the preferred embodiment of the invention.

FIG. 1 illustrates insulated ribbon cable 1 and a wire pin connector termination block assembly 20 including wire pins 12 protruding from rectangular apertures 4 in first base member 5, and retained in place by second cover member 6. Also visible in FIG. 1 are locating studs 24, assembly pins 8, grooves **7*a* in base member 5, and spacer bumps 9**. For convenience, the same numbering will be used in all figures when possible.

Figure 2:
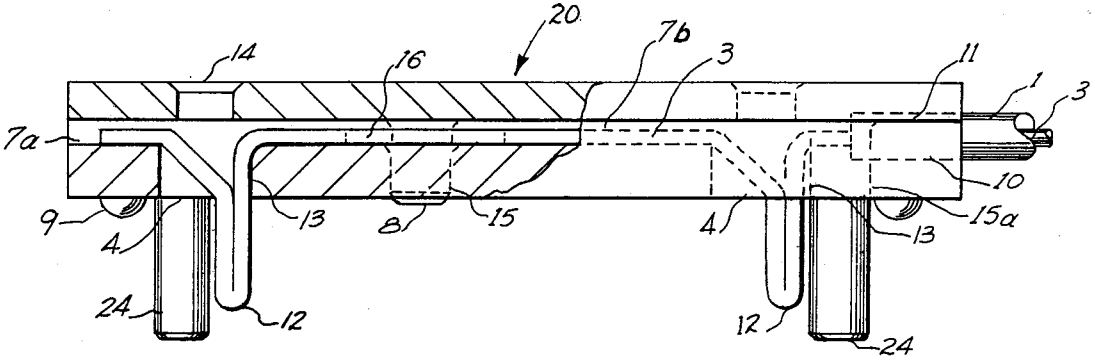
FIG. 2 is a side-elevational view, partially in section, of a wire pin connector termination block in accordance with the preferred embodiment of the invention.

As shown in FIG. 2, the insulation is removed from the conductors 3 of the ribbon cable 1 for a predetermined distance from the end. In the preferred embodiment, alternate uninsulated conductors 3 are cut to a shorter length. Ribbon cable 1 is shown in place in pockets 10 and 11, formed in members 5 and 6. Conductors 3 are shown formed into wire pins 12, protruding from base member 5 through apertures 4, and in contact with side 13 of apertures 4. Assembly pins 8 and locating studs 24 are shown frictionally engaged in apertures 15 and **15*a* to retain member 6 to member 5, although a glue or adhesive or the like could be used in place of frictional engagement of pins 8 and/or studs 24. Note that locating studs 24 are made to protrude further than wire pins 12, and are spaced between wire pins 12 and the edge of the termination block 20, to protect the pins 12 from mechanical damage before assembly, as well as to locate termination block 20** correctly on a printed circuit board, and to support and reinforce the connection between the ribbon cable and a printed circuit board.

Figure 3:
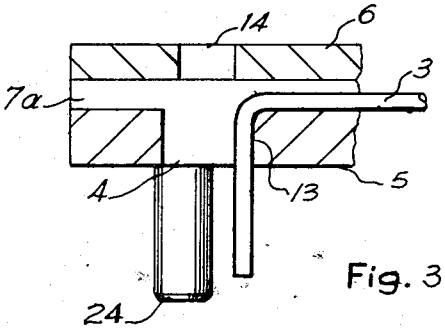
FIG. 3 is a fragmentary side-elevational view, partially in section, showing an alternate embodiment of a wire pin according to the invention.

FIG. 3 shows an alternate configuration, wherein conductor 3 is merely deflected through apertures 4, against side 13 of apertures 4, in an unfolded single-pin configuration suitable for soldered connection to printed circuit board conductors, where a wire pin connector termination block with this configuration is acceptable.

Figure 4:
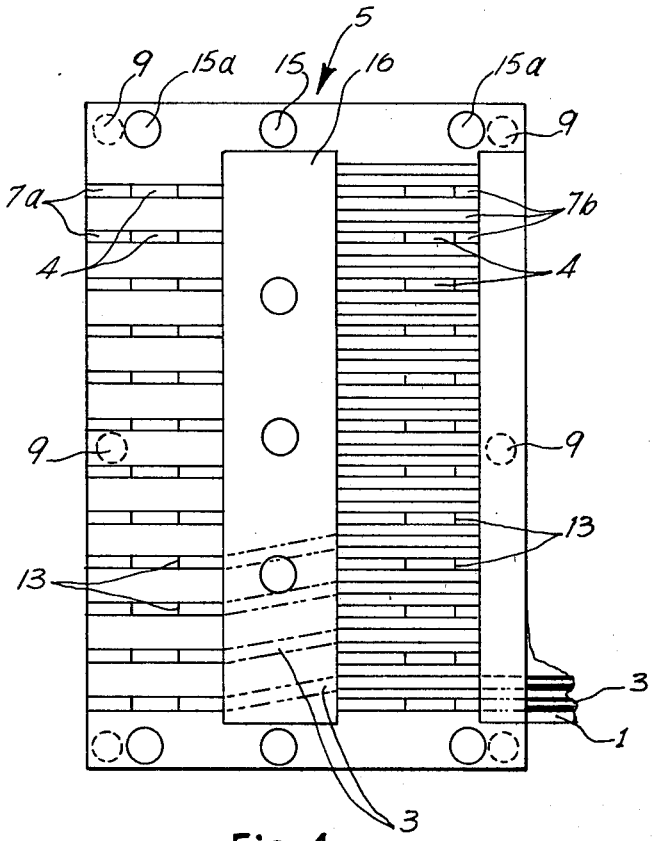
FIG. 4 is a top-elevational view of a first base member according to the preferred embodiment of the invention.

FIG. 4 shows the configuration of base member 5. Pocket 10, in cooperation with pocket 11 in cover member 6, provides a positive stop for insulated ribbon cable 1, so that it will not be drawn inward as conductors 3 are being formed into wire pins 12. Alternate ones of slots **7*b* are provided with apertures 4, for formation of wire pins from the alternate conductors that have been cut to a shorter length in accordance with the preferred embodiment of the invention. The remaining conductors are passed through pocket 16 and through slots 7*a*. Pocket 16 is provided to allow the longer alternate conductors 3 to be aligned with slots 7*a*, so that wire pins 12 may be arranged symetrically. It is apparent that pocket 16 could be eliminated, and slots 7*a* and 7*b* brought together to form continuous slots for either a symmetrical or offset pattern of wire pins 12, and that this would obviate the need for cutting alternate conductors 3** to a shorter length.

Figure 5:
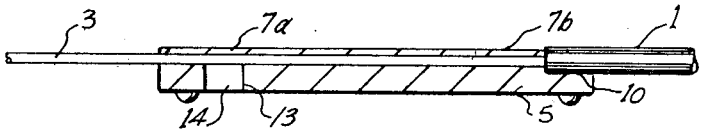
FIG. 5 is a side-elevational view, partially in section, showing the positions of the base member and the ribbon cable conductor prior to the formation of an electrical contact in accordance with the invention.
Figure 6:
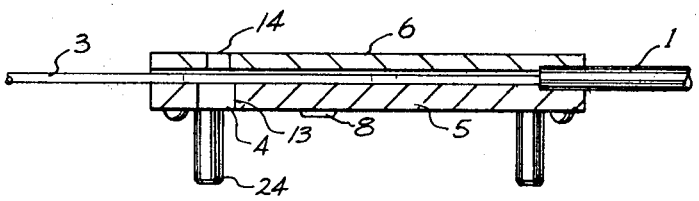
FIG. 6 is a side-elevational view, partially in section, showing a wire-pin connector termination block assembly prior to formation of electrical contacts in accordance with the invention.
Figure 7:
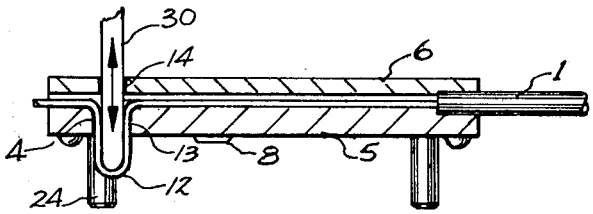
FIG. 7 is a side-elevational view, partially in section, of a wire pin connector termination block assembly showing a first step in forming a connector pin in accordance with the invention.
Figure 8:
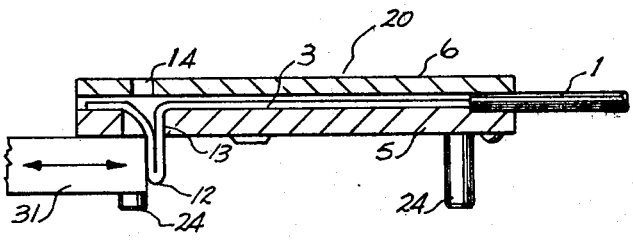
FIG. 8 shows a side-elevational view, partially in section, of a wire pin connector termination block showing a second step in forming a connector pin according to the preferred embodiment of the invention.
Figure 9:
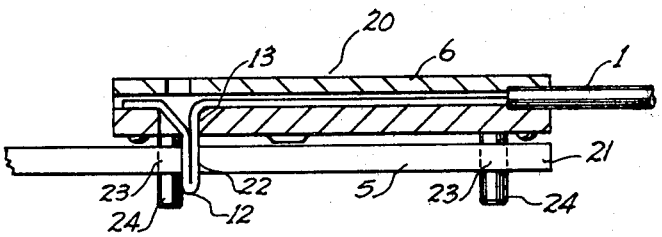
FIG. 9 is a side-elevational view, partially in section, of a completed wire pin connector termination block for ribbon cable according to the preferred embodiment of the invention, placed on a printed circuit board.

FIG. 5 shows a first assembly step in forming a wire pin connector termination block according to the invention. Ribbon cable 1 is stripped to a predetermined length to expose conductors 3. Ribbon cable 1 is placed into pocket 10 in base member 5, and a first portion of conductors 3 are layed into grooves *7a* and *7b*. In FIG. 6, cover member 6 is shown pressed into place on base member 5, retaining conductors 3 in place. FIG. 7 illustrates a first wire forming operation, where a first forming blade 30 is passed through apertures 4 and 14, aperture 14 being smaller than aperture 4 and serving as a guide for blade 30, forcing a second portion of conductor 3 into a U-shaped form protruding from aperture 4 in base member 5. FIG. 8 illustrates a second wire forming operation according to the invention, wherein a second forming blade 31 contacts the U-shape formed in conductor 3, to collapse it into a narrow U-shaped wire pin 12. As shown in FIG. 8, completed termination block 20 is placed onto a printed circuit board 21.

It will, therefore, be obvious that, in accordance with the invention, a ribbon cable can be quickly and easily terminated and fastened to a printed circuit board. While the wire pins 12, or the bent ends of conductors 3 as shown in FIG. 3, may be soldered to printed circuit board conductors, it is also apparent that wire pins 12 may be used to directly engage conventional plated-through holes on conventional printed circuit boards.

As will be apparent, members 5 and 6 must be made from, or at least covered with, an electrical insulator. In the preferred embodiment, members 5 and 6 are made by injection molding of a conventional thermosetting plastic material.

Modifications and additional embodiments of the invention will occur to those skilled in the art, and various modifications and additional embodiments of the invention may be made without departing from the scope of this invention.

I claim:

1. A wire pin connector kit for ribbon cable for clampingly retaining an end of said ribbon cable in preparation for forming terminals from ends of bared conductors of the ribbon cable by passing a tool through aligned apertures and deforming the bare conductors, comprising:

a first member having a plurality of first rectangular apertures therethrough;

a second member having a plurality of second rectangular apertures therethrough, and adapted to be retained against the first surface of said first member in substantial alignment with said first member and adapted to clamp an end of said ribbon cable therebetween;

said first apertures being longer than said second apertures and substantially equal in width to said second apertures;

and adapted to be in substantial alignment with said second apertures when said first member is in substantial alignment with said second member;

said first member including a plurality of grooves on said first surface adapted to retain the bared ribbon cable conductors in alignment with said first apertures and said second apertures;

a first surface of said second member including a plurality of studs protruding therefrom adapted to be pressed through and to protrude from said first member; and said first member including a plurality of third apertures adapted to receive said studs therethrough.

2. A wire pin connector for ribbon cable according to claim 1, wherein:

said first member has a plurality of fourth apertures therethrough; and said second member includes a plurality of pins protruding from said first surface, said pins being adapted to be frictionally received in said fourth apertures.

3. A wire pin connector kit for ribbon cable, comprising:

a first member having a plurality of first apertures therethrough;

a second member having a plurality of second apertures therethrough, said second member adapted to be retained against a first surface of said first member in substantial alignment with said first member, said second apertures adapted to be in substantial alignment with said first apertures when said first member and said second member are in substantial alignment;

said first apertures being adapted to receive therethrough a forming blade and at least one thickness of a ribbon cable conductor, said ribbon cable conductor being bent to be substantially perpendicular to said first surface;

said second apertures being smaller than said first apertures and adapted to be placed in the path of said forming blade, said first surface of said first member including a plurality of grooves adapted to retain at least one said ribbon cable conductor to alignment with one said first aperture.

4. A wire pin connector kit for ribbon cable according to claim 3, wherein:

a first surface of said second member includes a plurality of studs protruding therefrom; and said first member includes a plurality of third apertures therethrough, said third apertures being adapted to frictionally receive said studs therethrough;

said studs being adapted to at least in part retain said second member against said first member, and adapted to locate and support said wire pin connector upon a mounting surface.

5. A wire pin connector kit for ribbon cable according to claim 4, wherein:

said first surface of said second member includes a plurality of pins protruding therefrom, and said first member includes a plurality of fourth apertures therethrough, said apertures being adapted to frictionally receive said pins and at least in part retain said second member against said first member.

6. An electrical cable comprising a ribbon cable, including a plurality of parallel conductors and having a wire pin connector at an end thereof, said wire pin connector comprising:

a first member having a plurality of first apertures therethrough;

a second member;

said parallel conductors of said ribbon cable having an uninsulated portion extending for a predetermined distance from the end of said ribbon cable;

a portion of at least some of said parallel conductors in said uninsulated portion being bent to be substantially perpendicular to a first surface of said first member and extending through at least some of said first apertures;

said ribbon cable being retained between said first surface of said first member and a first surface of said second member adjacent said end of said ribbon cable;

said second member including a plurality of second apertures therethrough;

said first apertures being larger than said second apertures;

said first member including a plurality of grooves on said first surface;

said first surface of said second member including a plurality of studs protruding therefrom, and said first member including a plurality of third apertures adapted to frictionally receive said studs therethrough.

7. An electrical cable according to claim 6, wherein:

said first member includes a plurality of fourth apertures therethrough;

said second member has a plurality of pins projecting from said first surface, and said pins are adapted to frictionally engage said fourth apertures.

8. An electrical cable comprising a ribbon cable including a plurality of parallel conductors and a wire pin connector at at least one end of said ribbon cable, said wire pin connector comprising:

a first member having a plurality of first apertures therethrough;

a second member disposed adjacent to said first member;

said parallel conductors of said ribbon cable having an uninsulated portion extending for a predetermined distance from said end of said ribbon cable;

a first portion of at least one said conductor of said uninsulated portion being disposed between a first surface of said first member and a first surface of said second member;

a second portion of said conductor of said uninsulated portion being bent to be substantially perpendicular to said first member and protruding from one of said first apertures;

said first member including a plurality of grooves in alignment with said first apertures for retaining at least a portion of said conductor;

said first surface of said second member including a plurality of studs protruding therefrom;

said first member including a plurality of third apertures therethrough;

said studs extending through said third apertures and protruding therefrom.

9. An electrical cable according to claim 8, wherein:

said second portion of said conductor is formed as a U-shaped cross section having a bight and two legs, said legs being in substantial contact with each other.

10. An electrical cable according to claim 8, wherein:

said second member includes a plurality of second apertures therethrough, said second apertures being aligned with said first apertures, and said second apertures being smaller than said first apertures.

11. An electrical cable according to claim 8, wherein:

said first surface of said second member includes a plurality of pins protruding therefrom;

said first member includes a plurality of fourth apertures; and said pins are frictionally engaged in said fourth apertures.

* * * * *